US009151138B2

(12) United States Patent
Merron et al.

(10) Patent No.: US 9,151,138 B2
(45) Date of Patent: Oct. 6, 2015

(54) INJECTION OF FLUID INTO SELECTED ONES OF MULTIPLE ZONES WITH WELL TOOLS SELECTIVELY RESPONSIVE TO MAGNETIC PATTERNS

(75) Inventors: Matthew James Merron, Dallas, TX (US); Matt T. Howell, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 787 days.

(21) Appl. No.: 13/440,727

(22) Filed: Apr. 5, 2012

(65) Prior Publication Data

US 2013/0048291 A1 Feb. 28, 2013

Related U.S. Application Data

(63) Continuation-in-part of application No. 13/219,790, filed on Aug. 29, 2011, now abandoned.

(51) Int. Cl.

| | |
|---|---|
| ***E21B 43/16*** | (2006.01) |
| ***E21B 23/00*** | (2006.01) |
| ***E21B 34/06*** | (2006.01) |
| ***E21B 34/14*** | (2006.01) |
| ***E21B 34/08*** | (2006.01) |

(Continued)

(52) U.S. Cl.

CPC ..... *E21B 34/063* (2013.01); *E21B 34/08* (2013.01); *E21B 34/102* (2013.01); *E21B 34/103* (2013.01); *E21B 34/14* (2013.01); *E21B 41/00* (2013.01); *E21B 43/14* (2013.01); *E21B 43/162* (2013.01); *E21B 43/26* (2013.01); *E21B 2034/007* (2013.01)

(58) Field of Classification Search

CPC ..... E21B 43/14; E21B 34/14; E21B 34/063
USPC ..... 166/318, 332.4
See application file for complete search history.

(56) References Cited

U.S. PATENT DOCUMENTS

| | | | |
|---|---|---|---|
| 2,189,936 | A | 8/1938 | Broyles |
| 2,189,937 | A | 2/1940 | Broyles |

(Continued)

FOREIGN PATENT DOCUMENTS

| | | | |
|---|---|---|---|
| WO | 02/20942 | A1 | 3/2002 |
| WO | 2010079327 | A1 | 7/2010 |

OTHER PUBLICATIONS

Specification and Drawings filed Jul. 23, 2013, U.S. Appl. No. 13/948,267, 38 pages.

(Continued)

*Primary Examiner* — Jennifer H Gay
*Assistant Examiner* — George Gray
(74) *Attorney, Agent, or Firm* — Locke Lord LLP

(57) ABSTRACT

A method of actuating a well tool can include producing a magnetic pattern in the well, thereby transmitting a corresponding magnetic signal to the well tool, and the well tool actuating in response to detection of the magnetic signal. A method of injecting fluid into selected ones of multiple zones can include producing a magnetic pattern in a tubular string having multiple injection valves interconnected therein, actuating a set of at least one of the injection valves in response to the magnetic pattern producing, producing another magnetic pattern in the tubular string, and actuating another set of at least one of the injection valves in response to the second magnetic pattern producing.

21 Claims, 14 Drawing Sheets

(51) Int. Cl.

| | |
|---|---|
| ***E21B 41/00*** | (2006.01) |
| ***E21B 43/14*** | (2006.01) |
| ***E21B 43/26*** | (2006.01) |
| ***E21B 34/10*** | (2006.01) |
| *E21B 34/00* | (2006.01) |

(56) References Cited

U.S. PATENT DOCUMENTS

| | | | | |
|---|---|---|---|---|
| 2,308,004 | A | 1/1943 | Hart | |
| 2,330,265 | A | 9/1943 | Burt | |
| 2,373,006 | A | 4/1945 | Baker | |
| 2,381,929 | A | 8/1945 | Schlumberger | |
| 2,618,343 | A | 11/1952 | Conrad | |
| 2,637,402 | A | 5/1953 | Baker et al. | |
| 2,640,547 | A | 6/1953 | Baker et al. | |
| 2,695,064 | A | 11/1954 | Ragan et al. | |
| 2,961,045 | A * | 11/1960 | Stogner et al. | 166/75.15 |
| 2,974,727 | A | 3/1961 | Goodwin | |
| 3,029,873 | A | 4/1962 | Hanes | |
| 3,055,430 | A | 9/1962 | Campbell | |
| 3,122,728 | A | 2/1964 | Lindberg, Jr. | |
| 3,160,209 | A | 12/1964 | Bonner | |
| RE25,846 | E | 8/1965 | Campbell | |
| 3,233,674 | A | 2/1966 | Leutwyler | |
| 3,266,575 | A | 8/1966 | Owen | |
| 3,398,803 | A | 8/1968 | Leutwyler et al. | |
| 4,085,590 | A | 4/1978 | Powell et al. | |
| 4,282,931 | A | 8/1981 | Golben | |
| 4,352,397 | A | 10/1982 | Christopher | |
| 4,377,209 | A | 3/1983 | Golben | |
| 4,385,494 | A | 5/1983 | Golben | |
| 4,402,187 | A | 9/1983 | Golben et al. | |
| 4,574,889 | A | 3/1986 | Pringle | |
| 4,598,769 | A | 7/1986 | Robertson | |
| 4,606,416 | A | 8/1986 | Knighton et al. | |
| 4,884,953 | A | 12/1989 | Golben | |
| 5,024,270 | A | 6/1991 | Bostick | |
| 5,074,940 | A | 12/1991 | Ochi et al. | |
| 5,101,907 | A | 4/1992 | Schultz et al. | |
| 5,197,758 | A | 3/1993 | Lund et al. | |
| 5,211,224 | A | 5/1993 | Bouldin | |
| 5,238,070 | A | 8/1993 | Schultz et al. | |
| 5,249,630 | A | 10/1993 | Meaders et al. | |
| 5,316,081 | A | 5/1994 | Baski et al. | |
| 5,316,087 | A | 5/1994 | Manke et al. | |
| 5,396,951 | A | 3/1995 | Ross | |
| 5,452,763 | A | 9/1995 | Owen | |
| 5,476,018 | A | 12/1995 | Nakanishi et al. | |
| 5,485,884 | A | 1/1996 | Hanley et al. | |
| 5,531,845 | A | 7/1996 | Flanigan et al. | |
| 5,573,307 | A | 11/1996 | Wilkinson et al. | |
| 5,585,726 | A | 12/1996 | Chau | |
| 5,666,050 | A | 9/1997 | Bouldin et al. | |
| 5,673,556 | A | 10/1997 | Goldben et al. | |
| 5,687,791 | A | 11/1997 | Beck et al. | |
| 5,700,974 | A | 12/1997 | Taylor | |
| 6,041,864 | A | 3/2000 | Patel et al. | |
| 6,128,904 | A | 10/2000 | Rosso, Jr. et al. | |
| 6,142,226 | A | 11/2000 | Vick | |
| 6,152,232 | A | 11/2000 | Webb et al. | |
| 6,167,974 | B1 | 1/2001 | Webb | |
| 6,186,226 | B1 | 2/2001 | Robertson | |
| 6,305,467 | B1 | 10/2001 | Connell et al. | |
| 6,315,043 | B1 | 11/2001 | Farrant et al. | |
| 6,343,658 | B2 | 2/2002 | Webb | |
| 6,378,611 | B1 | 4/2002 | Helderle | |
| 6,536,524 | B1 | 3/2003 | Snider | |
| 6,557,637 | B1 | 5/2003 | Dore et al. | |
| 6,561,479 | B1 | 5/2003 | Eldridge | |
| 6,568,470 | B2 | 5/2003 | Goodson, Jr. et al. | |
| 6,598,679 | B2 | 7/2003 | Robertson | |
| 6,651,747 | B2 | 11/2003 | Chen et al. | |
| 6,684,950 | B2 | 2/2004 | Patel | |
| 6,695,061 | B2 | 2/2004 | Fripp et al. | |
| 6,705,425 | B2 | 3/2004 | West | |
| 6,776,255 | B2 | 8/2004 | West et al. | |
| 6,925,937 | B2 | 8/2005 | Robertson | |
| 6,962,215 | B2 | 11/2005 | Curtis et al. | |
| 6,971,449 | B1 | 12/2005 | Robertson | |
| 6,973,993 | B2 | 12/2005 | West et al. | |
| 7,083,009 | B2 | 8/2006 | Paluch et al. | |
| 7,152,679 | B2 | 12/2006 | Simpson | |
| 7,191,672 | B2 | 3/2007 | Ringgenberg et al. | |
| 7,197,923 | B1 | 4/2007 | Wright et al. | |
| 7,237,616 | B2 * | 7/2007 | Patel | 166/381 |
| 7,252,152 | B2 | 8/2007 | LoGiudice et al. | |
| 7,395,882 | B2 | 7/2008 | Oldham et al. | |
| 7,413,011 | B1 | 8/2008 | Chee et al. | |
| 7,431,335 | B2 | 10/2008 | Khandhadia et al. | |
| 7,597,151 | B2 | 10/2009 | Curtis et al. | |
| 7,604,062 | B2 | 10/2009 | Murray | |
| 2004/0227509 | A1 * | 11/2004 | Ucan | 324/220 |
| 2005/0115708 | A1 | 6/2005 | Jabusch | |
| 2005/0260468 | A1 | 11/2005 | Fripp et al. | |
| 2006/0124310 | A1 * | 6/2006 | Lopez de Cardenas et al. | 166/313 |
| 2006/0144590 | A1 | 7/2006 | Lopez de Cardenas et al. | |
| 2007/0039508 | A1 | 2/2007 | Saito et al. | |
| 2007/0089911 | A1 | 4/2007 | Moyes | |
| 2008/0236840 | A1 | 10/2008 | Nguy | |
| 2009/0301233 | A1 | 12/2009 | Irani et al. | |
| 2009/0308588 | A1 | 12/2009 | Howell et al. | |
| 2010/0084060 | A1 | 4/2010 | Hinshaw et al. | |
| 2010/0201352 | A1 | 8/2010 | Englert | |
| 2011/0232917 | A1 | 9/2011 | Skinner et al. | |
| 2011/0240301 | A1 | 10/2011 | Robinson et al. | |
| 2011/0240311 | A1 * | 10/2011 | Robison et al. | 166/373 |
| 2011/0265987 | A1 | 11/2011 | Wright et al. | |
| 2011/0284240 | A1 | 11/2011 | Chen et al. | |
| 2012/0006562 | A1 | 1/2012 | Speer et al. | |

OTHER PUBLICATIONS

Specification and Drawings filed Jul. 23, 2013, U.S. Appl. No. 13/948,278, 37 pages.

Office Action issued Jul. 11, 2013 for U.S. Appl. No. 13/219,790, 40 pages.

Office Action issued Jul. 10, 2014 for U.S. Appl. No. 13/219,790, 14 pages.

Storr; "The Hall Effect Sensor", Electronics Tutorial, dated 1999-2014, 8 pages.

Swagatam; "Types, Working Principle of Hall Effects ICs", Bright Hub Engineering website, dated Feb. 22, 2011, 3 pages.

Office Action issued Feb. 21, 2014 for U.S. Appl. No. 13/219,790, 33 pages.

International Preliminary Report on Patentability and Written Opinion issued for International Patent Application No. PCT/US06/023947 dated Jan. 24, 2008, 6 pages.

Anonymous; "Smart Plugging Tool System for Selectively Actuating Wellbore Valves", originally published in Prior Art Database, dated Jan. 7, 2008, 5 pages.

Halliburton; "Horizontal Completion Systems", article H03280, received Jun. 30, 2011, 14 pages.

Halliburton; "Delta Stim Lite Sleeve", article H06033, dated Jun. 2010, 3 pages.

Halliburton; "Delta Stim Sleeve", article H04616, dated Sep. 2008, 4 pages.

Office Action issued Feb. 10, 2005 for U.S. Appl. No. 10/426,917, 6 pages.

Office Action issued Mar. 1, 2007 for U.S. Appl. No. 11/180,140, 9 pages.

Office Action issued Sep. 17, 2007 for U.S. Appl. No. 11/180,140, 8 pages.

Office Action issued Sep. 9, 2008 for U.S. Appl. No. 11/180,140, 12 pages.

Office Action issued Oct. 27, 2008 for U.S. Appl. No. 11/180,140, 11 pages.

Office Action issued Feb. 26, 2009 for U.S. Appl. No. 11/180,140, 7 pages.

Halliburton; "Quick Trip Valve", article H02856R, dated Apr. 2002, 2 pages.

(56) References Cited

OTHER PUBLICATIONS

Pes; "Model DV Dual Control Line Operated Drill Through Lubricator Valve", marketing document, dated Jul. 27, 2001, 6 pages.
Weatherford; "Underbalanced Drilling: Undeniable Success", product article, dated Mar. 2002, 1 page.
Weatherford; "Products and Services Catalog", brochure # 01.01, dated 2002, 3 pages.
International Search Report and Written Opinion issued May 30, 2013 for PCT Patent Application No. PCT/US2013/029750, 18 pages.
Search Report issued Jun. 23, 2011 for International Patent Application Serial No. PCT/US10/61047, 5 pages.
Written Opinion issued Jun. 23, 2011 for International Patent Application Serial No. PCT/US10/61047, 4 pages.
Specification and Drawings for U.S. Appl. No. 12/831,240, filed Jul. 6, 2010, 65 pages.
Specification and Drawings for U.S. Appl. No. 12/962,621, filed Dec. 10, 2010, 32 pages.
Specification and Drawings for U.S. Appl. No. 13/219,790, filed Aug. 29, 2011, 49 pages.
Specification and Drawings for U.S. Appl. No. 13/025,041, filed Feb. 10, 2011, 71 pages.
Specification and Drawings for U.S. Appl. No. 13/151,457, filed Jun. 2, 2011, 78 pages.
Specification and Drawings for U.S. Appl. No. 13/025,039, filed Feb. 10, 2011, 69 pages.
Specification and Drawings for U.S. Appl. No. 13/539,392, filed Nov. 8, 2009, 47 pages.
Halliburton; "RapidFrac System", H08004, dated Oct. 2011, 3 pages.
Halliburton; "RapidFrac System", product presentation, dated 2011, 6 pages.
International Search Report with Written Opinion issued Mar. 11, 2013 for PCT Patent Application No. PCT/US12/050762, 14 pages.
International Search Report and Written Opinion issued Jul. 23, 2013 for PCT Patent Application No. PCT/US2013/029762, 14 pages.

* cited by examiner

INJECTION OF FLUID INTO SELECTED ONES OF MULTIPLE ZONES WITH WELL TOOLS SELECTIVELY RESPONSIVE TO MAGNETIC PATTERNS

CROSS-REFERENCE TO RELATED APPLICATION

This application is a continuation-in-part of prior U.S. application Ser. No. 13/219,790, filed 29 Aug. 2011. The entire disclosure of the prior application is incorporated herein by this reference.

BACKGROUND

This disclosure relates generally to equipment utilized and operations performed in conjunction with a subterranean well and, in an example described below, more particularly provides for injection of fluid into selected ones of multiple zones in a well, and provides for magnetic actuation of well tools.

It can be beneficial in some circumstances to individually, or at least selectively, inject fluid into multiple formation zones penetrated by a wellbore. For example, the fluid could be treatment, stimulation, fracturing, acidizing, conformance, or other type of fluid.

Therefore, it will be appreciated that improvements are continually needed in the art. These improvements could be useful in operations other than selectively injecting fluid into formation zones.

SUMMARY

In the disclosure below, systems and methods are provided which bring improvements to the art. One example is described below in which a magnetic device is used to open a selected one or more valves associated with different zones. Another example is described below in which different magnetic devices, or different combinations of magnetic devices can be used to actuate respective different ones of multiple well tools.

A method of actuating a well tool can include displacing a magnetic device pattern in the well, thereby transmitting a corresponding magnetic signal to the well tool, and the well tool actuating in response to detection of the magnetic signal.

In one aspect, a method of injecting fluid into selected ones of multiple zones penetrated by a wellbore is provided to the art by the disclosure below. In one example, the method can include displacing one or more magnetic devices into one or more valves in the wellbore, the valve(s) actuating in response to the magnetic device displacing, and injecting the fluid through the valve(s) and into at least one of the zones associated with the valve(s).

In another aspect, an injection valve for use in a subterranean well is described below. In one example, the injection valve can include a sensor which detects a magnetic field, and an actuator which opens the injection valve in response to detection of at least one predetermined magnetic signal by the sensor.

In a further aspect, another method of injecting fluid into selected ones of multiple zones penetrated by a wellbore is provided to the art. In one example described below, the method can include displacing a set of one or more magnetic devices through a tubular string having multiple injection valves interconnected therein, opening a set of the injection valves in response to the displacing of the magnetic device set, displacing another set of one or more magnetic devices through the tubular string, and opening another set of one or more injection valves in response to the second magnetic device set displacing.

A magnetic device described below can, in one example, comprise multiple magnetic field-producing components arranged in a pattern on a sphere.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
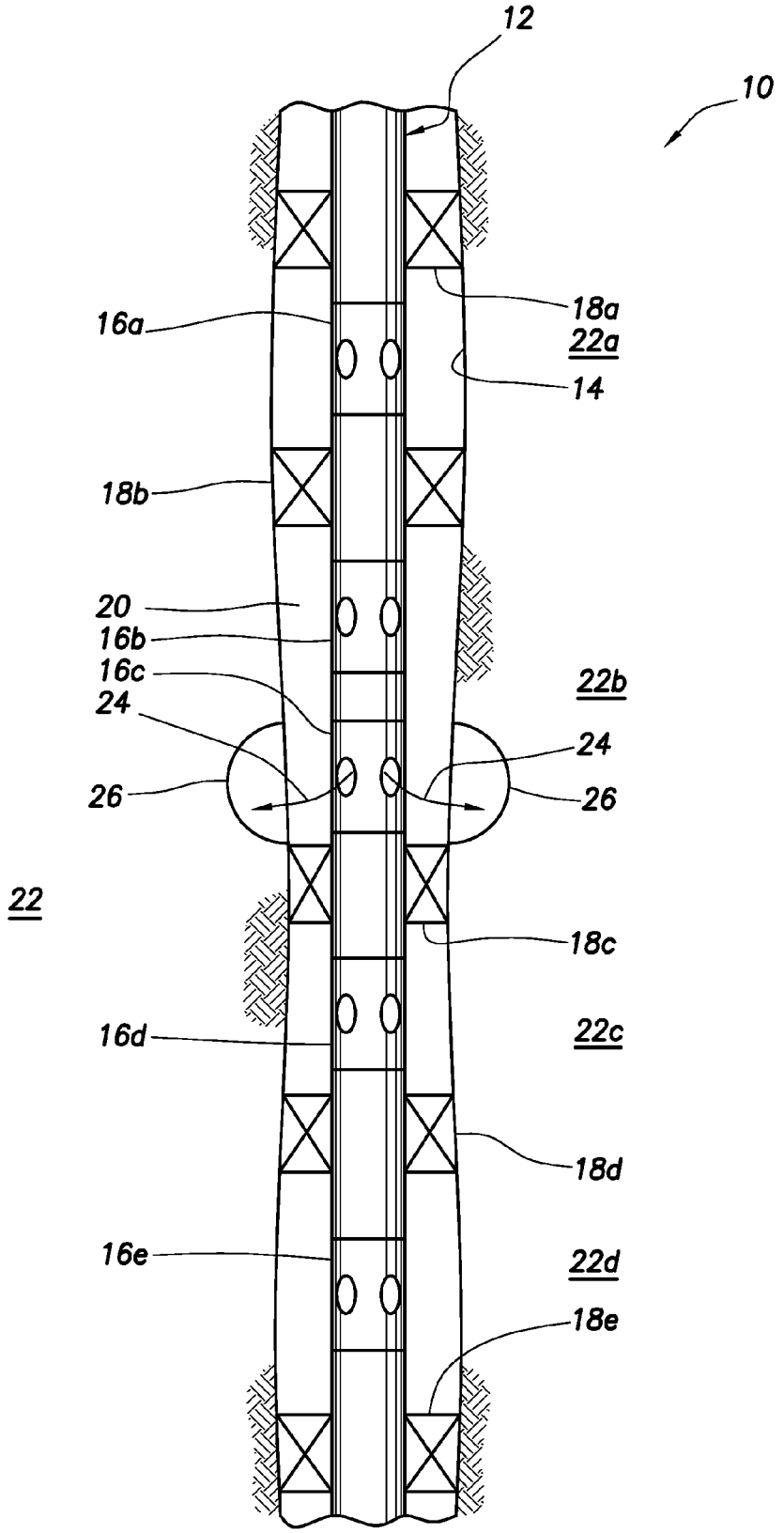
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. In this example, a tubular string 12 is positioned in a wellbore 14, with the tubular string having multiple injection valves 16*a-e* and packers 18*a-e* interconnected therein.

The tubular string 12 may be of the type known to those skilled in the art as casing, liner, tubing, a production string, a work string, etc. Any type of tubular string may be used and remain within the scope of this disclosure.

The packers 18*a-e* seal off an annulus 20 formed radially between the tubular string 12 and the wellbore 14. The packers 18*a-e* in this example are designed for sealing engagement with an uncased or open hole wellbore 14, but if the wellbore is cased or lined, then cased hole-type packers may be used instead. Swellable, inflatable, expandable and other types of packers may be used, as appropriate for the well conditions, or no packers may be used (for example, the tubular string 12 could be expanded into contact with the wellbore 14, the tubular string could be cemented in the wellbore, etc.).

In the FIG. 1 example, the injection valves 16*a-e* permit selective fluid communication between an interior of the tubular string 12 and each section of the annulus 20 isolated between two of the packers 18*a-e*. Each section of the annulus 20 is in fluid communication with a corresponding earth formation zone 22*a-d*. Of course, if packers 18*a-e* are not used, then the injection valves 16*a-e* can otherwise be placed in communication with the individual zones 22*a-d*, for example, with perforations, etc.

The zones 22*a-d* may be sections of a same formation 22, or they may be sections of different formations. Each zone 22*a-d* may be associated with one or more of the injection valves 16*a-e*.

In the FIG. 1 example, two injection valves 16*b,c* are associated with the section of the annulus 20 isolated between the packers 18*b,c*, and this section of the annulus is in communication with the associated zone 22*b*. It will be appreciated that any number of injection valves may be associated with a zone.

It is sometimes beneficial to initiate fractures 26 at multiple locations in a zone (for example, in tight shale formations, etc.), in which cases the multiple injection valves can provide for injecting fluid 24 at multiple fracture initiation points along the wellbore 14. In the example depicted in FIG. 1, the valve 16*c* has been opened, and fluid 24 is being injected into the zone 22*b*, thereby forming the fractures 26.

Preferably, the other valves 16*a,b,d,e* are closed while the fluid 24 is being flowed out of the valve 16*c* and into the zone 22*b*. This enables all of the fluid 24 flow to be directed toward forming the fractures 26, with enhanced control over the operation at that particular location.

However, in other examples, multiple valves 16*a-e* could be open while the fluid 24 is flowed into a zone of an earth formation 22. In the well system 10, for example, both of the valves 16*b,c* could be open while the fluid 24 is flowed into the zone 22*b*. This would enable fractures to be formed at multiple fracture initiation locations corresponding to the open valves.

It will, thus, be appreciated that it would be beneficial to be able to open different sets of one or more of the valves 16*a-e* at different times. For example, one set (such as valves 16*b,c*) could be opened at one time (such as, when it is desired to form fractures 26 into the zone 22*b*), and another set (such as valve 16*a*) could be opened at another time (such as, when it is desired to form fractures into the zone 22*a*).

One or more sets of the valves 16*a-e* could be open simultaneously. However, it is generally preferable for only one set of the valves 16*a-e* to be open at a time, so that the fluid 24 flow can be concentrated on a particular zone, and so flow into that zone can be individually controlled.

At this point, it should be noted that the well system 10 and method is described here and depicted in the drawings as merely one example of a wide variety of possible systems and methods which can incorporate the principles of this disclosure. Therefore, it should be understood that those principles are not limited in any manner to the details of the system 10 or associated method, or to the details of any of the components thereof (for example, the tubular string 12, the wellbore 14, the valves 16*a-e*, the packers 18*a-e*, etc.).

It is not necessary for the wellbore 14 to be vertical as depicted in FIG. 1, for the wellbore to be uncased, for there to be five each of the valves 16*a-e* and packers, for there to be four of the zones 22*a-d*, for fractures 26 to be formed in the zones, etc. The fluid 24 could be any type of fluid which is injected into an earth formation, e.g., for stimulation, conformance, acidizing, fracturing, water-flooding, steam-flooding, treatment, or any other purpose. Thus, it will be appreciated that the principles of this disclosure are applicable to many different types of well systems and operations.

In other examples, the principles of this disclosure could be applied in circumstances where fluid is not only injected, but is also (or only) produced from the formation 22. Thus, well tools other than injection valves can benefit from the principles described herein.

Figure 2:
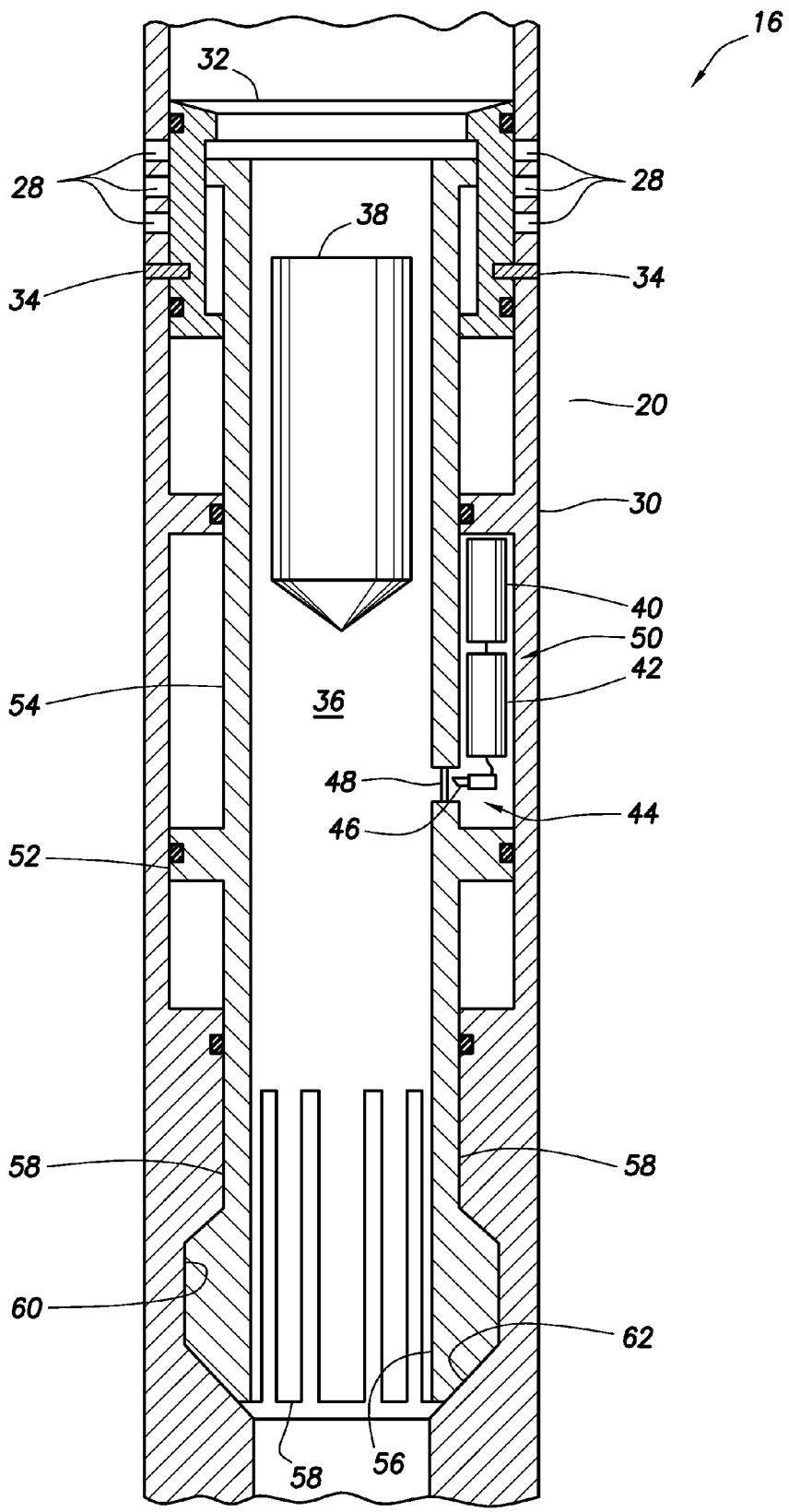
FIG. 2 is a representative cross-sectional view of an injection valve which may be used in the well system and method, and which can embody the principles of this disclosure.

Referring additionally now to FIG. 2, an enlarged scale cross-sectional view of one example of the injection valve 16 is representatively illustrated. The injection valve 16 of FIG. 2 may be used in the well system 10 and method of FIG. 1, or it may be used in other well systems and methods, while still remaining within the scope of this disclosure.

In the FIG. 2 example, the valve 16 includes openings 28 in a sidewall of a generally tubular housing 30. The openings 28 are blocked by a sleeve 32, which is retained in position by shear members 34.

In this configuration, fluid communication is prevented between the annulus 20 external to the valve 16, and an internal flow passage 36 which extends longitudinally through the valve (and which extends longitudinally through the tubular string 12 when the valve is interconnected therein). The valve 16 can be opened, however, by shearing the shear members 34 and displacing the sleeve 32 (downward as viewed in FIG. 2) to a position in which the sleeve does not block the openings 28.

To open the valve 16, a magnetic device 38 is displaced into the valve to activate an actuator 50 thereof. The magnetic device 38 is depicted in FIG. 2 as being generally cylindrical, but other shapes and types of magnetic devices (such as, balls, darts, plugs, fluids, gels, etc.) may be used in other examples. For example, a ferrofluid, magnetorheological fluid, or any other fluid having magnetic properties which can be sensed by the sensor 40, could be pumped to or past the sensor in order to transmit a magnetic signal to the actuator 50.

The magnetic device 38 may be displaced into the valve 16 by any technique. For example, the magnetic device 38 can be dropped through the tubular string 12, pumped by flowing fluid through the passage 36, self-propelled, conveyed by wireline, slickline, coiled tubing, etc.

The magnetic device 38 has known magnetic properties, and/or produces a known magnetic field, or pattern or combination of magnetic fields, which is/are detected by a magnetic sensor 40 of the valve 16. The magnetic sensor 40 can be any type of sensor which is capable of detecting the presence of the magnetic field(s) produced by the magnetic device 38, and/or one or more other magnetic properties of the magnetic device.

Suitable sensors include (but are not limited to) giant magneto-resistive (GMR) sensors, Hall-effect sensors, conductive coils, etc. Permanent magnets can be combined with the magnetic sensor 40 in order to create a magnetic field that is disturbed by the magnetic device 38. A change in the magnetic field can be detected by the sensor 40 as an indication of the presence of the magnetic device 38.

The sensor 40 is connected to electronic circuitry 42 which determines whether the sensor has detected a particular predetermined magnetic field, or pattern or combination of magnetic fields, or other magnetic properties of the magnetic device 38. For example, the electronic circuitry 42 could have the predetermined magnetic field(s) or other magnetic properties programmed into non-volatile memory for comparison to magnetic fields/properties detected by the sensor 40. The electronic circuitry 42 could be supplied with electrical power via an on-board battery, a downhole generator, or any other electrical power source.

In one example, the electronic circuitry 42 could include a capacitor, wherein an electrical resonance behavior between the capacitance of the capacitor and the magnetic sensor 40 changes, depending on whether the magnetic device 38 is present. In another example, the electronic circuitry 42 could include an adaptive magnetic field that adjusts to a baseline magnetic field of the surrounding environment (e.g., the formation 22, surrounding metallic structures, etc.). The electronic circuitry 42 could determine whether the measured magnetic fields exceed the adaptive magnetic field level.

In one example, the sensor 40 could comprise an inductive sensor which can detect the presence of a metallic device (e.g., by detecting a change in a magnetic field, etc.). The metallic device (such as a metal ball or dart, etc.) can be considered a magnetic device 38, in the sense that it conducts a magnetic field and produces changes in a magnetic field which can be detected by the sensor 40.

If the electronic circuitry 42 determines that the sensor 40 has detected the predetermined magnetic field(s) or change(s) in magnetic field(s), the electronic circuitry causes a valve device 44 to open. In this example, the valve device 44 includes a piercing member 46 which pierces a pressure barrier 48.

The piercing member 46 can be driven by any means, such as, by an electrical, hydraulic, mechanical, explosive, chemical or other type of actuator. Other types of valve devices 44 (such as those described in U.S. patent application Ser. Nos. 12/688,058 and 12/353,664, the entire disclosures of which are incorporated herein by this reference) may be used, in keeping with the scope of this disclosure.

When the valve device 44 is opened, a piston 52 on a mandrel 54 becomes unbalanced (e.g., a pressure differential is created across the piston), and the piston displaces downward as viewed in FIG. 2. This displacement of the piston 52 could, in some examples, be used to shear the shear members 34 and displace the sleeve 32 to its open position.

However, in the FIG. 2 example, the piston 52 displacement is used to activate a retractable seat 56 to a sealing position thereof. As depicted in FIG. 2, the retractable seat 56 is in the form of resilient collets 58 which are initially received in an annular recess 60 formed in the housing 30. In this position, the retractable seat 56 is retracted, and is not capable of sealingly engaging the magnetic device 38 or any other form of plug in the flow passage 36.

When the piston 52 displaces downward, the collets 58 are deflected radially inward by an inclined face 62 of the recess 60, and the seat 56 is then in its sealing position. A plug (such as, a ball, a dart, a magnetic device 38, etc.) can sealingly engage the seat 56, and increased pressure can be applied to the passage 36 above the plug to thereby shear the shear members 34 and downwardly displace the sleeve 32 to its open position.

As mentioned above, the retractable seat 56 may be sealingly engaged by the magnetic device 38 which initially activates the actuator 50 (e.g., in response to the sensor 40 detecting the predetermined magnetic field(s) or change(s) in magnetic field(s) produced by the magnetic device), or the retractable seat may be sealingly engaged by another magnetic device and/or plug subsequently displaced into the valve 16.

Furthermore, the retractable seat 56 may be actuated to its sealing position in response to displacement of more than one magnetic device 38 into the valve 16. For example, the electronic circuitry 42 may not actuate the valve device 44 until a predetermined number of the magnetic devices 38 have been displaced into the valve 16, and/or until a predetermined spacing in time is detected, etc.

Figure 3:
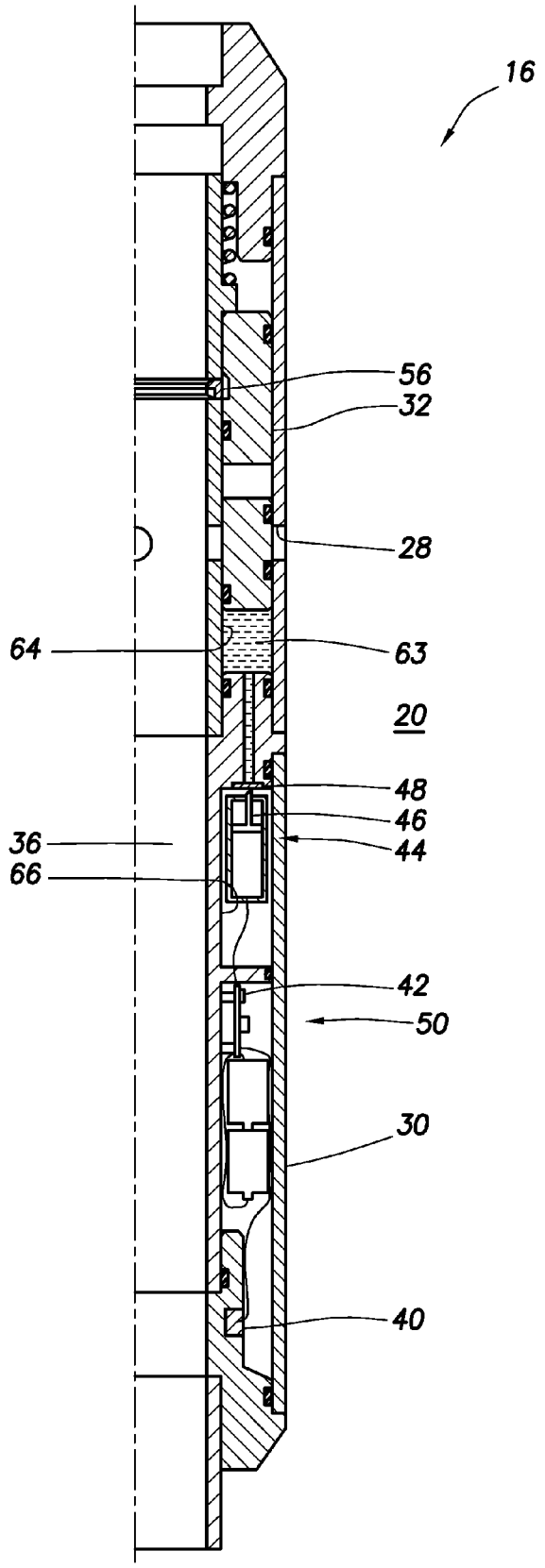
FIGS. 3-6 are a representative cross-sectional views of another example of the injection valve, in run-in, actuated and reverse flow configurations thereof.

Referring additionally now to FIGS. 3-6, another example of the injection valve 16 is representatively illustrated. In this example, the sleeve 32 is initially in a closed position, as depicted in FIG. 3. The sleeve 32 is displaced to its open position (see FIG. 4) when a support fluid 63 is flowed from one chamber 64 to another chamber 66.

Figure 4:
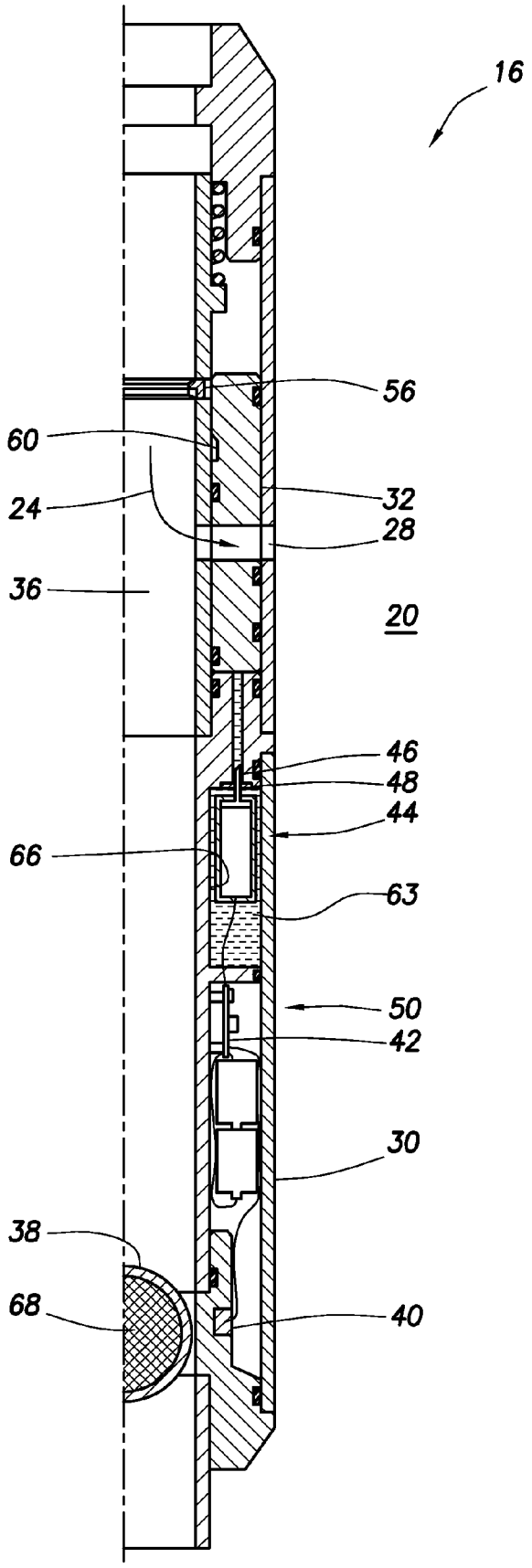

The chambers 64, 66 are initially isolated from each other by the pressure barrier 48. When the sensor 40 detects the predetermined magnetic signal(s) produced by the magnetic device(s) 38, the piercing member 46 pierces the pressure barrier 48, and the support fluid 63 flows from the chamber 64 to the chamber 66, thereby allowing a pressure differential across the sleeve 32 to displace the sleeve downward to its open position, as depicted in FIG. 4.

Fluid 24 can now be flowed outward through the openings 28 from the passage 36 to the annulus 20. Note that the retractable seat 56 is now extended inwardly to its sealing position. In this example, the retractable seat 56 is in the form of an expandable ring which is extended radially inward to its sealing position by the downward displacement of the sleeve 32.

In addition, note that the magnetic device 38 in this example comprises a ball or sphere. Preferably, one or more permanent magnets 68 or other type of magnetic field-producing components are included in the magnetic device 38.

Figure 5:
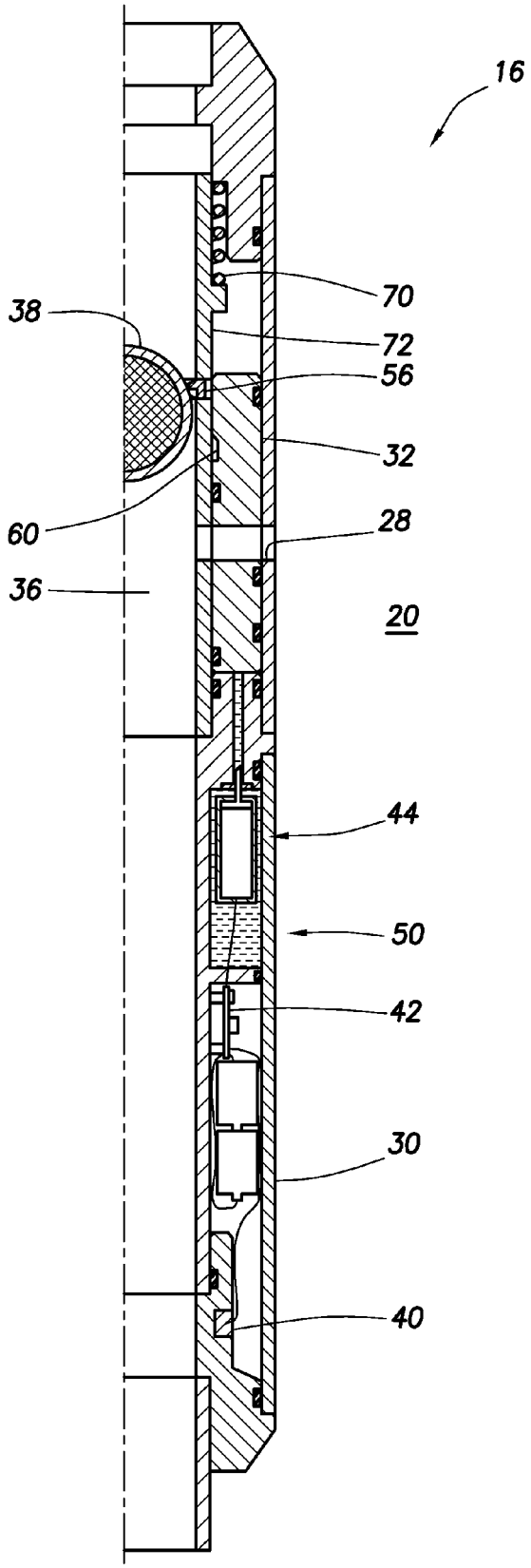

In FIG. 5, the magnetic device 38 is retrieved from the passage 36 by reverse flow of fluid through the passage 36 (e.g., upward flow as viewed in FIG. 5). The magnetic device 38 is conveyed upwardly through the passage 36 by this reverse flow, and eventually engages in sealing contact with the seat 56, as depicted in FIG. 5.

Figure 6:
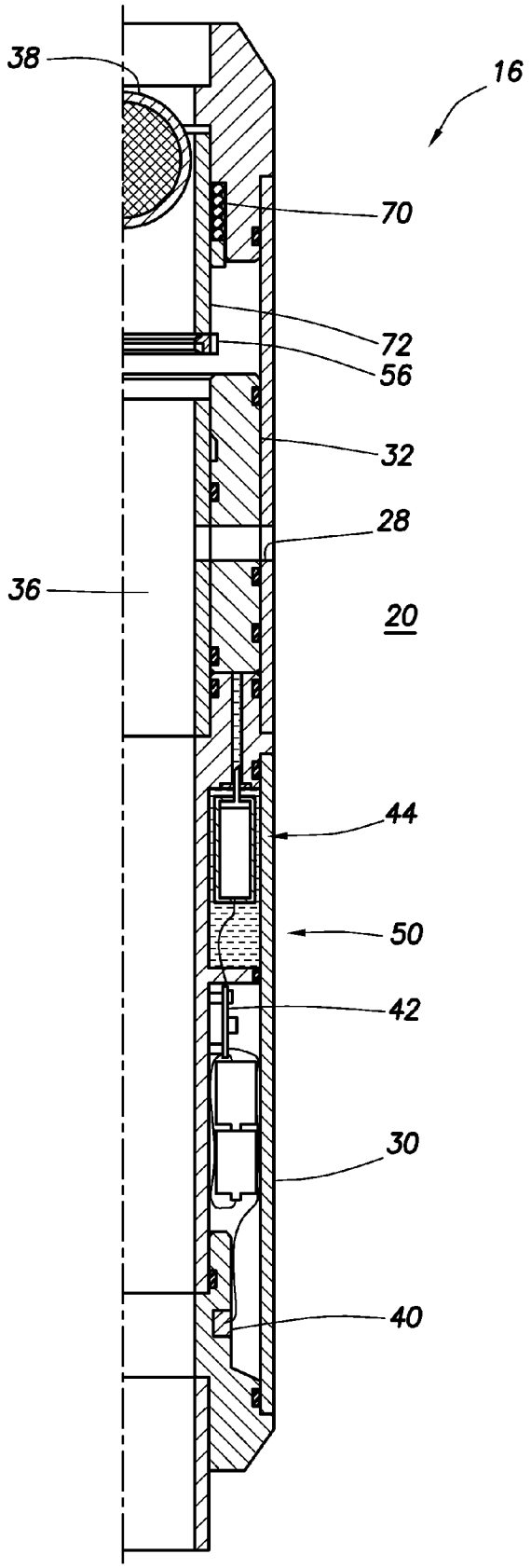

In FIG. 6, a pressure differential across the magnetic device 38 and seat 56 causes them to be displaced upward against a downward biasing force exerted by a spring 70 on a retainer sleeve 72. When the biasing force is overcome, the magnetic device 38, seat 56 and sleeve 72 are displaced upward, thereby allowing the seat 56 to expand outward to its retracted position, and allowing the magnetic device 38 to be conveyed upward through the passage 36, e.g., for retrieval to the surface.

Note that in the FIGS. 2 & 3-6 examples, the seat 58 is initially expanded or "retracted" from its sealing position, and is later deflected inward to its sealing position. In the FIGS. 3-6 example, the seat 58 can then be again expanded (see FIG. 6) for retrieval of the magnetic device 38 (or to otherwise minimize obstruction of the passage 36).

The seat 58 in both of these examples can be considered "retractable," in that the seat can be in its inward sealing position, or in its outward non-sealing position, when desired. Thus, the seat 58 can be in its non-sealing position when initially installed, and then can be actuated to its sealing position (e.g., in response to detection of a predetermined pattern or combination of magnetic fields), without later being actuated to its sealing position again, and still be considered a "retractable" seat.

Figure 7:
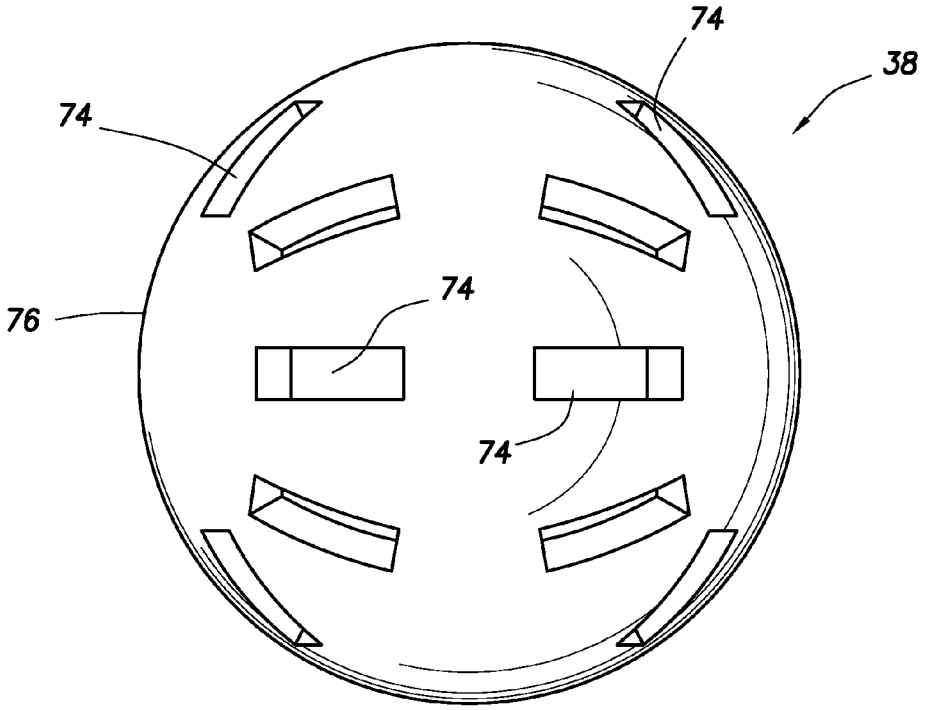
FIGS. 7 & 8 are representative side and plan views of a magnetic device which may be used with the injection valve.
Figure 8:
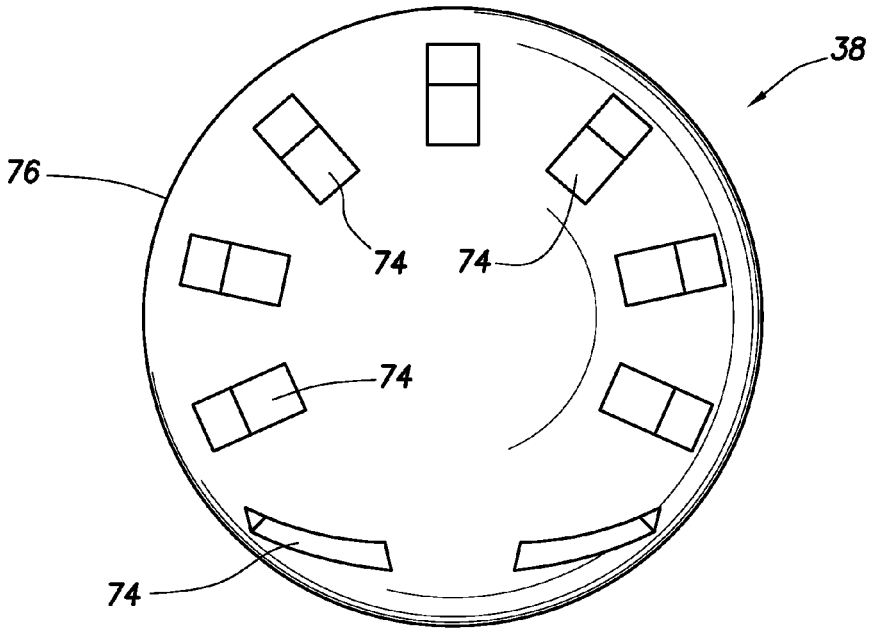

Referring additionally now to FIGS. 7 & 8, another example of the magnetic device 38 is representatively illustrated. In this example, magnets (not shown in FIGS. 7 & 8, see, e.g., permanent magnet 68 in FIG. 4) are retained in recesses 74 formed in an outer surface of a sphere 76.

The recesses 74 are arranged in a pattern which, in this case, resembles that of stitching on a baseball. In FIGS. 7 & 8, the pattern comprises spaced apart positions distributed along a continuous undulating path about the sphere 76. However, it should be clearly understood that any pattern of magnetic field-producing components may be used in the magnetic device 38, in keeping with the scope of this disclosure.

The magnets 68 are preferably arranged to provide a magnetic field a substantial distance from the device 38, and to do so no matter the orientation of the sphere 76. The pattern depicted in FIGS. 7 & 8 desirably projects the produced magnetic field(s) substantially evenly around the sphere 76.

Figure 9:
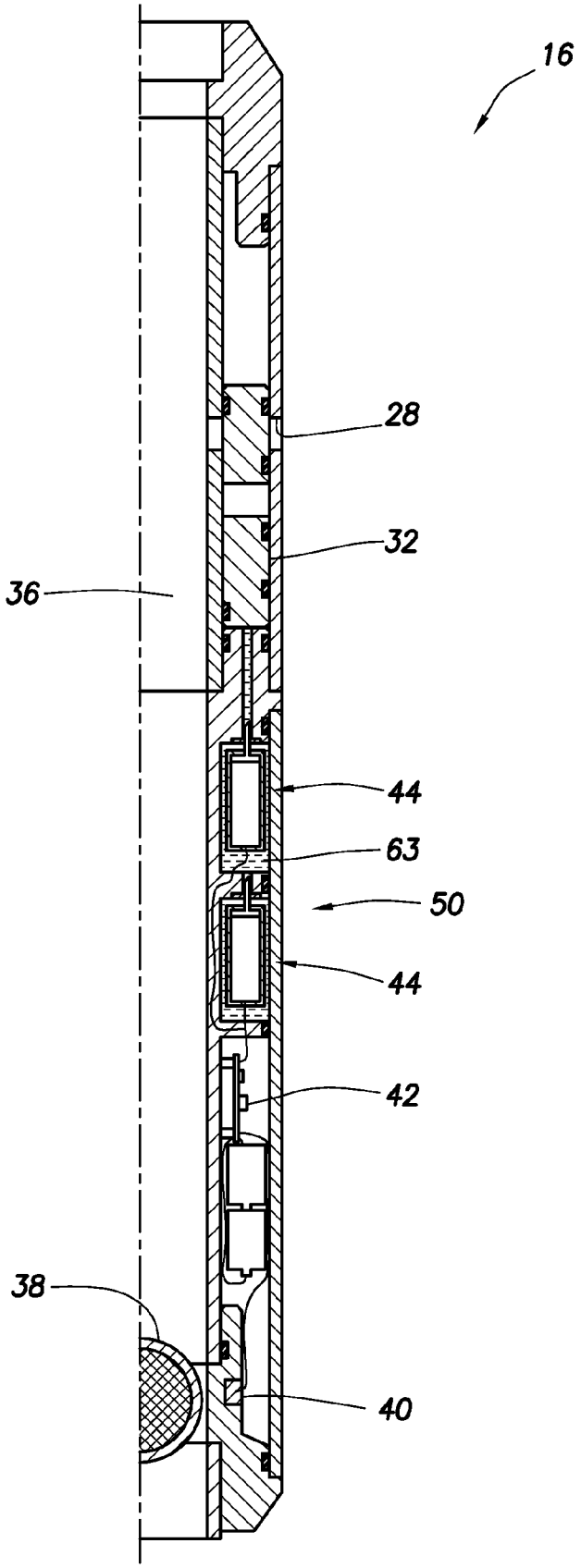
FIG. 9 is a representative cross-sectional view of another example of the injection valve.

Referring additionally now to FIG. 9, another example of the injection valve 16 is representatively illustrated. In this example, the actuator 50 includes two of the valve devices 44.

When one of the valve devices 44 opens, a sufficient amount of the support fluid 63 is drained to displace the sleeve 32 to its open position (similar to, e.g., FIG. 4), in which the fluid 24 can be flowed outward through the openings 28. When the other valve device 44 opens, more of the support fluid 63 is drained, thereby further displacing the sleeve 32 to a closed position (as depicted in FIG. 9), in which flow through the openings 28 is prevented by the sleeve.

Various different techniques may be used to control actuation of the valve devices 44. For example, one of the valve devices 44 may be opened when a first magnetic device 38 is displaced into the valve 16, and the other valve device may be opened when a second magnetic device is displaced into the valve. As another example, the second valve device 44 may be actuated in response to passage of a predetermined amount of time from a particular magnetic device 38, or a predetermined number of magnetic devices, being detected by the sensor 40.

As yet another example, the first valve device 44 may actuate when a certain number of magnetic devices 38 have been displaced into the valve 16, and the second valve device 44 may actuate when another number of magnetic devices have been displaced into the valve. Thus, it should be understood that any technique for controlling actuation of the valve devices 44 may be used, in keeping with the scope of this disclosure.

Figure 10A:
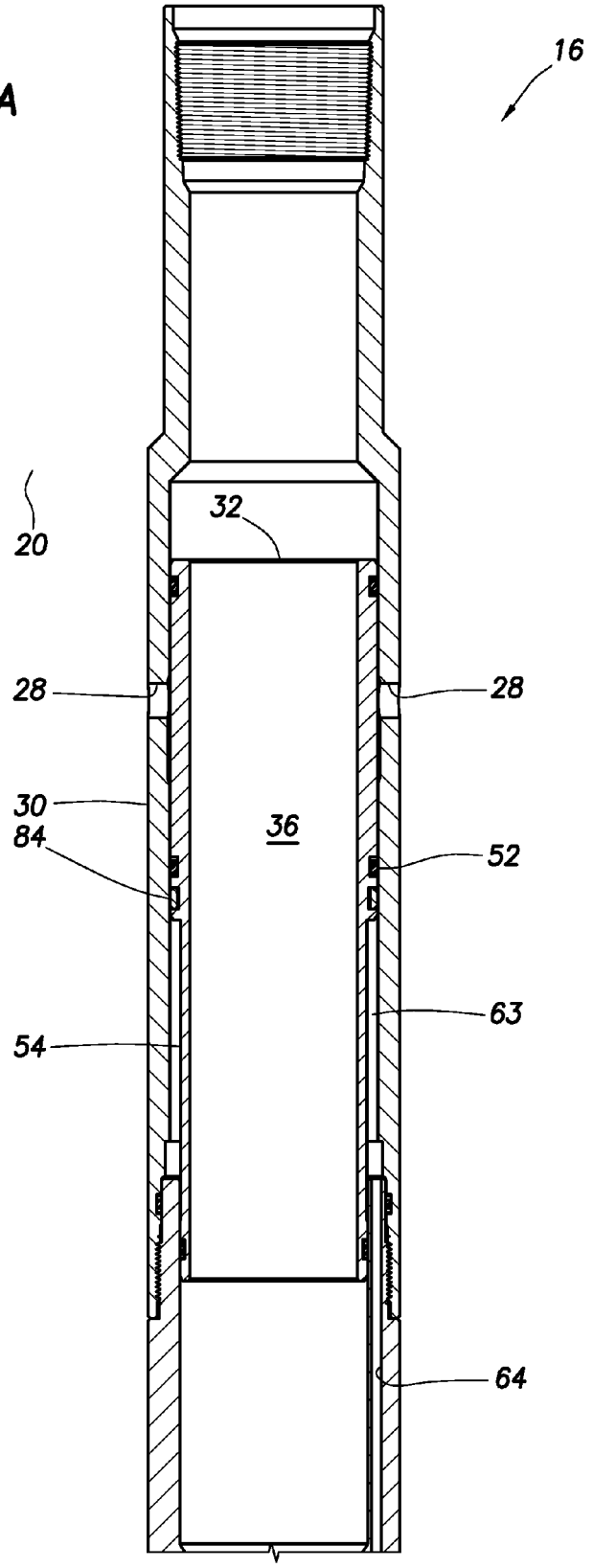
FIGS. 10A & B are representative cross-sectional views of successive axial sections of another example of the injection valve, in a closed configuration.
Figure 10B:
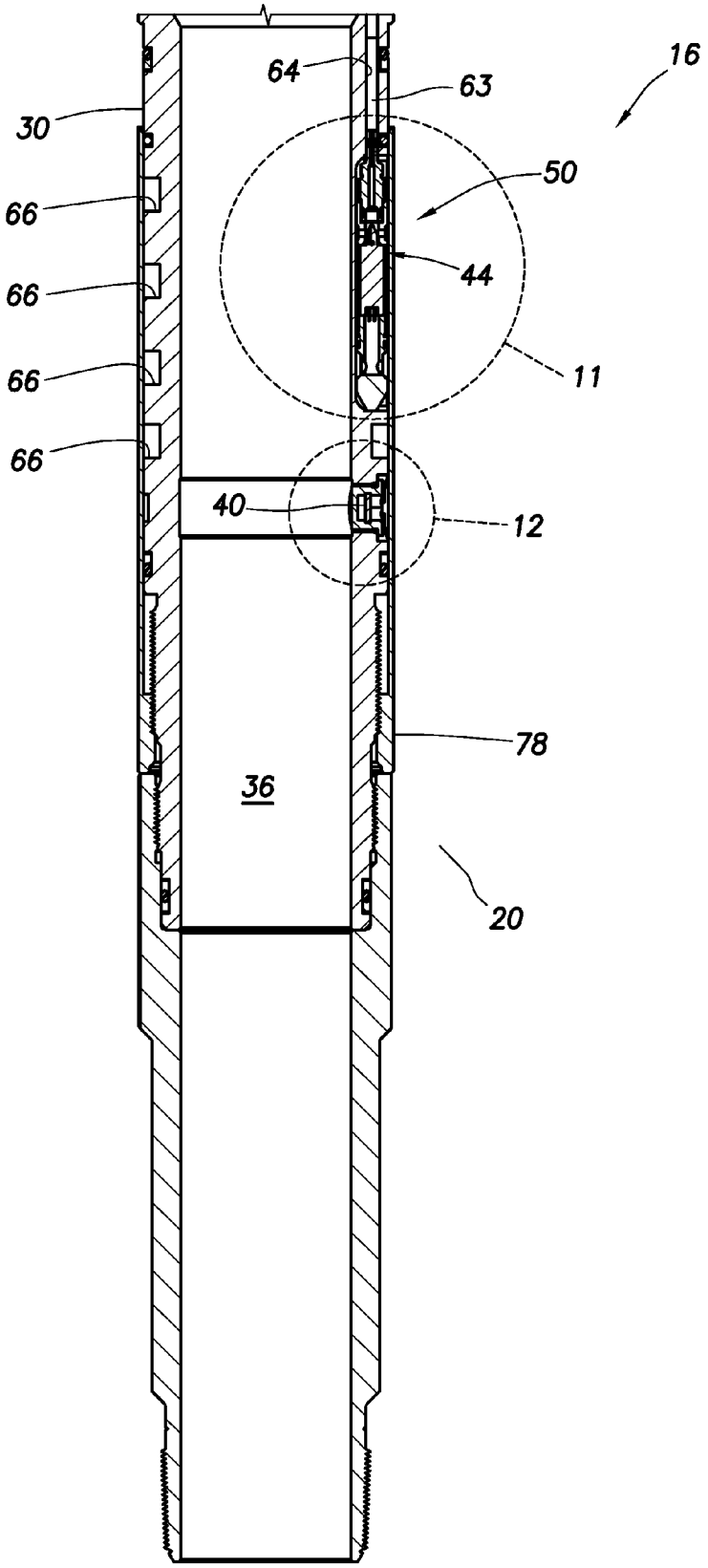
Figure 11:
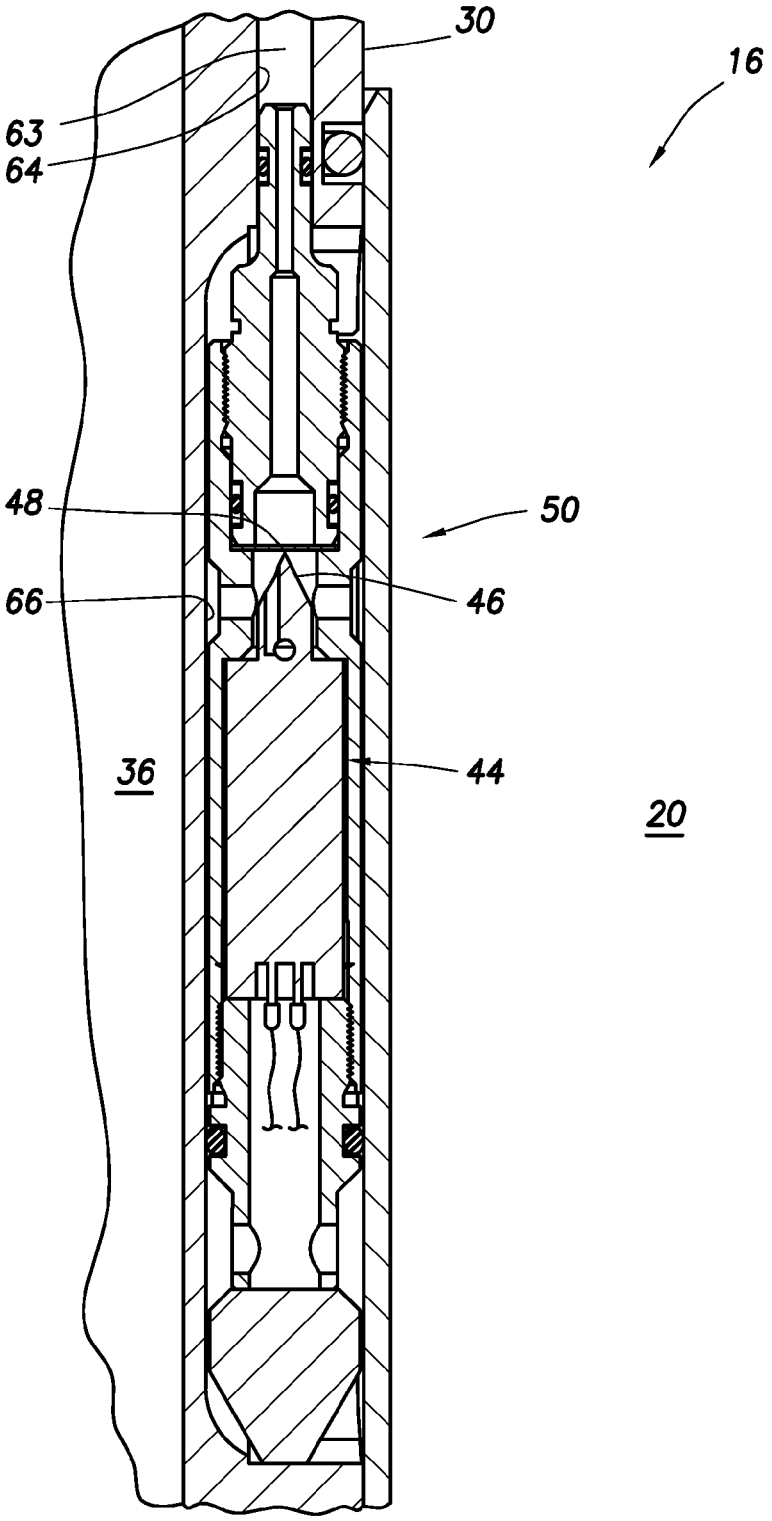
FIG. 11 is an enlarged scale representative cross-sectional view of a valve device which may be used in the injection valve.
Figure 12:
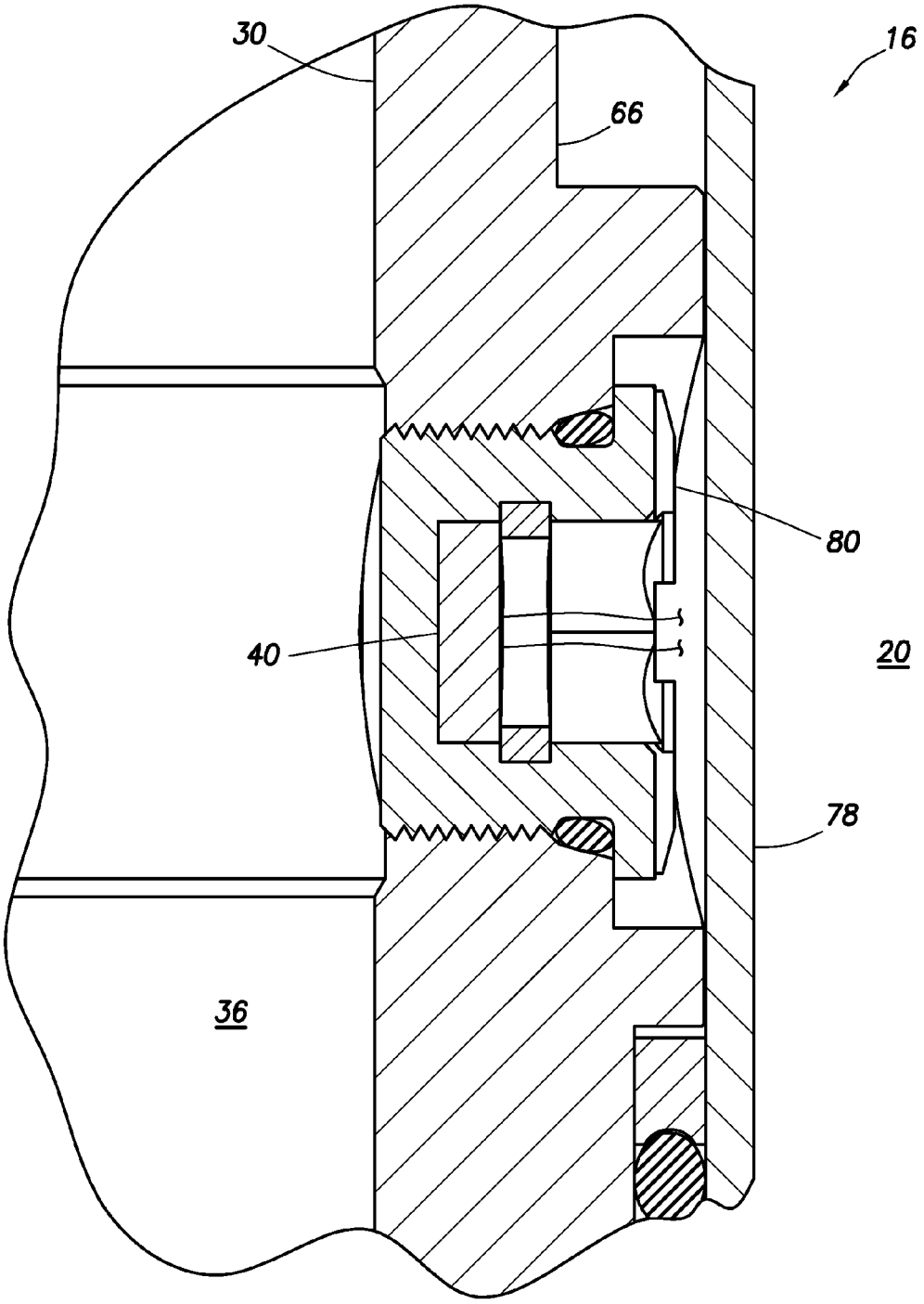
FIG. 12 is an enlarged scale representative cross-sectional view of a magnetic sensor which may be used in the injection valve.

Referring additionally now to FIGS. 10A-13B, another example of the injection valve 16 is representatively illustrated. In FIGS. 10A & B, the valve 16 is depicted in a closed configuration, whereas in FIGS. 13A & B, the valve is depicted in an open configuration. FIG. 11 depicts an enlarged scale view of the actuator 50. FIG. 12 depicts an enlarged scale view of the magnetic sensor 40.

In FIGS. 10A & B, it may be seen that the support fluid 63 is contained in the chamber 64, which extends as a passage to the actuator 50. In addition, the chamber 66 comprises multiple annular recesses extending about the housing 30. A sleeve 78 isolates the chamber 66 and actuator 50 from well fluid in the annulus 20.

In FIG. 11, the manner in which the pressure barrier 48 isolates the chamber 64 from the chamber 66 can be more clearly seen. When the valve device 44 is actuated, the piercing member 46 pierces the pressure barrier 48, allowing the support fluid 63 to flow from the chamber 64 to the chamber 66 in which the valve device 44 is located.

Initially, the chamber 66 is at or near atmospheric pressure, and contains air or an inert gas. Thus, the support fluid 63 can readily flow into the chamber 66, allowing the sleeve 32 to displace downwardly, due to the pressure differential across the piston 52.

In FIG. 12, the manner in which the magnetic sensor 40 is positioned for detecting magnetic fields and/or magnetic field changes in the passage 36 can be clearly seen. In this example, the magnetic sensor 40 is mounted in a nonmagnetic plug 80 secured in the housing 30 in close proximity to the passage 36.

Figure 13A:
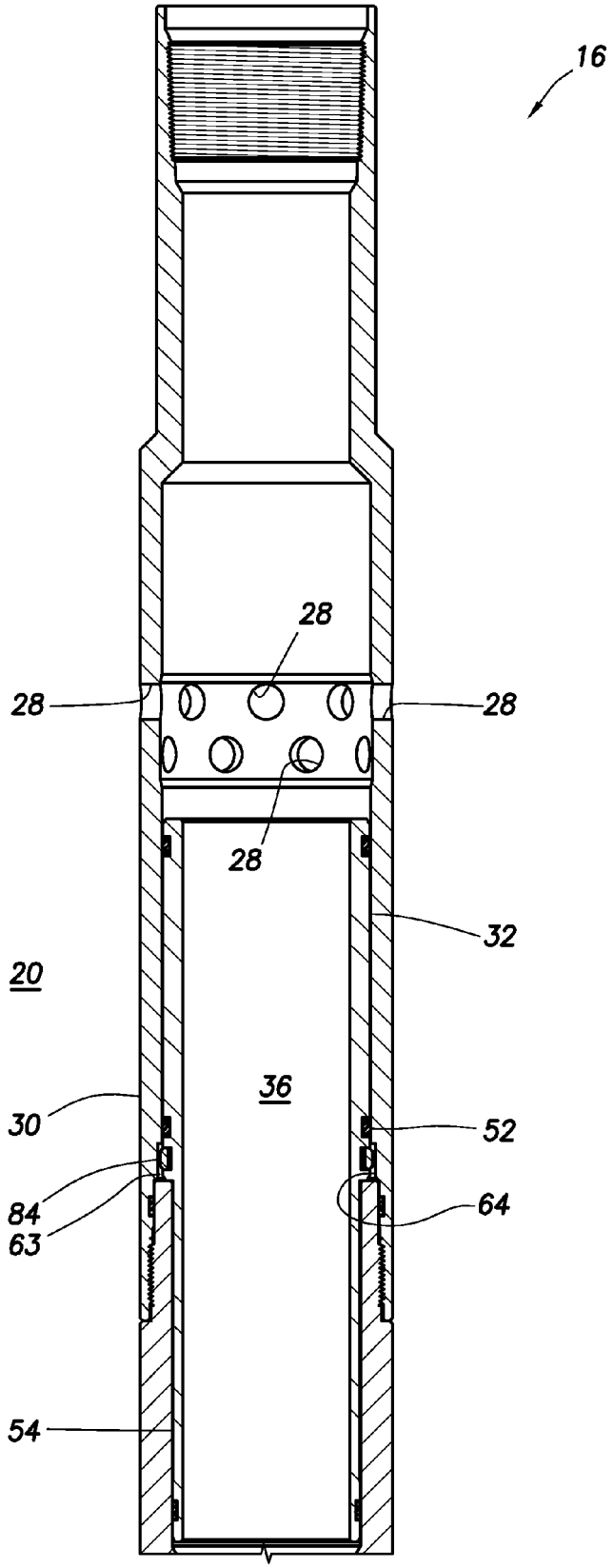
FIGS. 13A & B are representative cross-sectional views of successive axial sections of the injection valve, in an open configuration.
Figure 13B:
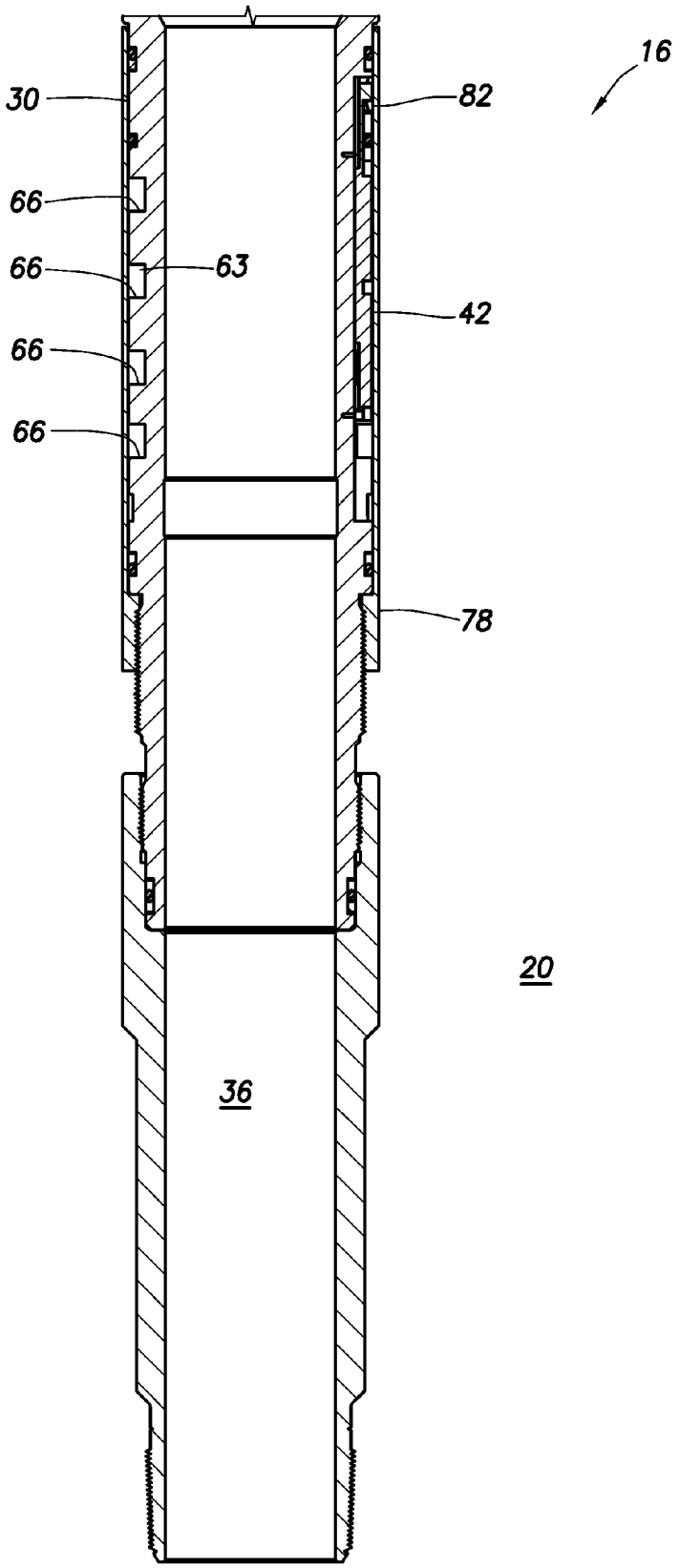

In FIGS. 13A & B, the injection valve 16 is depicted in an open configuration, after the valve device 44 has been actuated to cause the piercing member 46 to pierce the pressure barrier 48. The support fluid 63 has drained into the chamber 66, allowing the sleeve 32 to displace downward and uncover the openings 28, and thereby permitting flow through the sidewall of the housing 30.

A locking member 84 (such as a resilient C-ring) expands outward when the sleeve 32 displaces to its open position. When expanded, the locking member 84 prevents re-closing of the sleeve 32.

The actuator 50 is not visible in FIGS. 13A & B, since the cross-sectional view depicted in FIGS. 13A & B is rotated somewhat about the injection valve's longitudinal axis. In this view, the electronic circuitry 42 is visible, disposed between the housing 30 and the outer sleeve 78.

A contact 82 is provided for interfacing with the electronic circuitry 42 (for example, comprising a hybridized circuit with a programmable processor, etc.), and for switching the electronic circuitry on and off. With the outer sleeve 78 in a downwardly displaced position (as depicted in FIGS. 10A & B), the contact 82 can be accessed by an operator. The outer sleeve 78 would be displaced to its upwardly disposed position (as depicted in FIGS. 13A & B) prior to installing the valve 16 in a well.

Although in the examples of FIGS. 2-13B, the sensor 40 is depicted as being included in the valve 16, it will be appreciated that the sensor could be otherwise positioned. For example, the sensor 40 could be located in another housing interconnected in the tubular string 12 above or below one or more of the valves 16*a-e* in the system 10 of FIG. 1. Multiple sensors 40 could be used, for example, to detect a pattern of magnetic field-producing components on a magnetic device 38. Thus, it should be understood that the scope of this disclosure is not limited to any particular positioning or number of the sensor(s) 40.

In examples described above, the sensor 40 can detect magnetic signals which correspond to displacing one or more magnetic devices 38 in the well (e.g., through the passage 36, etc.) in certain respective patterns. The transmitting of different magnetic signals (corresponding to respective different patterns of displacing the magnetic devices 38) can be used to actuate corresponding different sets of the valves 16*a-e*.

Thus, displacing a pattern of magnetic devices 38 in a well can be used to transmit a corresponding magnetic signal to well tools (such as valves 16*a-e*, etc.), and at least one of the well tools can actuate in response to detection of the magnetic signal. The pattern may comprise a predetermined number of the magnetic devices 38, a predetermined spacing in time of the magnetic devices 38, or a predetermined spacing in time between predetermined numbers of the magnetic devices 38, etc. Any pattern may be used in keeping with the scope of this disclosure.

The magnetic device pattern can comprise a predetermined magnetic field pattern (such as, the pattern of magnetic field-producing components on the magnetic device 38 of FIGS. 7 & 8, etc.), a predetermined pattern of multiple magnetic fields (such as, a pattern produced by displacing multiple magnetic devices 38 in a certain manner through the well, etc.), a predetermined change in a magnetic field (such as, a change produced by displacing a metallic device past or to the sensor 40), and/or a predetermined pattern of multiple magnetic field changes (such as, a pattern produced by displacing multiple metallic devices in a certain manner past or to the sensor 40, etc.). Any manner of producing a magnetic device pattern may be used, within the scope of this disclosure.

A first set of the well tools might actuate in response to detection of a first magnetic signal. A second set of the well tools might actuate in response to detection of another magnetic signal. The second magnetic signal can correspond to a second unique magnetic device pattern produced in the well.

The term "pattern" is used in this context to refer to an arrangement of magnetic field-producing components (such as permanent magnets 68, etc.) of a magnetic device 38 (as in the FIGS. 7 & 8 example), and to refer to a manner in which multiple magnetic devices can be displaced in a well. The sensor 40 can, in some examples, detect a pattern of magnetic field-producing components of a magnetic device 38. In other examples, the sensor 40 can detect a pattern of displacing multiple magnetic devices.

The sensor 40 may detect a pattern on a single magnetic device 38, such as the magnetic device of FIGS. 7 & 8. In another example, magnetic field-producing components could be axially spaced on a magnetic device 38, such as a dart, rod, etc. In some examples, the sensor 40 may detect a pattern of different North-South poles of the magnetic device 38. By detecting different patterns of different magnetic field-producing components, the electronic circuitry 42 can determine whether an actuator 50 of a particular well tool should actuate or not, should actuate open or closed, should actuate more open or more closed, etc.

The sensor 40 may detect patterns created by displacing multiple magnetic devices 38 in the well. For example, three magnetic devices 38 could be displaced in the valve 16 (or past or to the sensor 40) within three minutes of each other, and then no magnetic devices could be displaced for the next three minutes.

The electronic circuitry 42 can receive this pattern of indications from the sensor 40, which encodes a digital command for communicating with the well tools (e.g., "waking" the well tool actuators 50 from a low power consumption "sleep" state). Once awakened, the well tool actuators 50 can, for example, actuate in response to respective predetermined numbers, timing, and/or other patterns of magnetic devices 38 displacing in the well. This method can help prevent extraneous activities (such as, the passage of wireline tools, etc. through the valve 16) from being misidentified as an operative magnetic signal.

In one example, the valve 16 can open in response to a predetermined number of magnetic devices 38 being displaced through the valve. By setting up the valves 16*a-e* in the system 10 of FIG. 1 to open in response to different numbers of magnetic devices 38 being displaced through the valves, different ones of the valves can be made to open at different times.

For example, the valve 16*e* could open when a first magnetic device 38 is displaced through the tubular string 12. The valve 16*d* could then be opened when a second magnetic device 38 is displaced through the tubular string 12. The valves 16*b,c* could be opened when a third magnetic device 38 is displaced through the tubular string 12. The valve 16*a* could be opened when a fourth magnetic device 38 is displaced through the tubular string 12.

Any combination of number of magnetic device(s) 38, pattern on one or more magnetic device(s), pattern of magnetic devices, spacing in time between magnetic devices, etc., can be detected by the magnetic sensor 40 and evaluated by the electronic circuitry 42 to determine whether the valve 16 should be actuated. Any unique combination of number of magnetic device(s) 38, pattern on one or more magnetic device(s), pattern of magnetic devices, spacing in time between magnetic devices, etc., may be used to select which of multiple sets of valves 16 will be actuated.

Another use for the actuator 50 (in any of its FIGS. 2-13B configurations) could be in actuating multiple injection valves. For example, the actuator 50 could be used to actuate multiple ones of the RAPIDFRAC™ Sleeve marketed by Halliburton Energy Services, Inc. of Houston, Tex. USA. The actuator 50 could initiate metering of a hydraulic fluid in the RAPIDFRAC™ Sleeves in response to a particular magnetic device 38 being displaced through them, so that all of them open after a certain period of time.

It may now be fully appreciated that the above disclosure provides several advancements to the art. The injection valve 16 can be conveniently and reliably opened by displacing the magnetic device 38 into the valve, or otherwise detecting a particular magnetic signal by a sensor of the valve. Selected ones or sets of injection valves 16 can be individually opened, when desired, by displacing a corresponding one or more magnetic devices 38 into the selected valve(s). The magnetic device(s) 38 may have a predetermined pattern of magnetic field-producing components, or otherwise emit a predetermined combination of magnetic fields, in order to actuate a corresponding predetermined set of injection valves 16*a-e*.

The above disclosure describes a method of injecting fluid 24 into selected ones of multiple zones 22*a-d* penetrated by a wellbore 14. In one example, the method can include producing a magnetic pattern, at least one valve 16 actuating in response to the producing step, and injecting the fluid 24 through the valve 16 and into at least one of the zones 22*a-d* associated with the valve 16. The valve(s) 16 could actuate to an open (or at least more open, from partially open to fully open, etc.) configuration in response to the magnetic pattern producing step.

The valve 16 may actuate in response to displacing a predetermined number of magnetic devices 38 into the valve 16.

A retractable seat 56 may be activated to a sealing position in response to the displacing step.

The valve 16 may actuate in response to a magnetic device 38 having a predetermined magnetic pattern, in response to a predetermined magnetic signal being transmitted from the magnetic device 38 to the valve, and/or in response to a sensor 40 of the valve 16 detecting a magnetic field of the magnetic device 38.

The valve 16 may close in response to at least two of the magnetic devices 38 being displaced into the valve 16.

The method can include retrieving the magnetic device 38 from the valve 16. Retrieving the magnetic device 38 may include expanding a retractable seat 56 and/or displacing the magnetic device 38 through a seat 56.

The magnetic device 38 may comprise multiple magnetic field-producing components (such as multiple magnets 68, etc.) arranged in a pattern on a sphere 76. The pattern can comprise spaced apart positions distributed along a continuous undulating path about the sphere 76.

Also described above is an injection valve 16 for use in a subterranean well. In one example, the injection valve 16 can include a sensor 40 which detects a magnetic field, and an actuator 50 which opens the injection valve 16 in response to detection of at least one predetermined magnetic signal by the sensor 40.

The actuator 50 may open the injection valve 16 in response to a predetermined number of magnetic signals being detected by the sensor 40.

The injection valve 16 can also include a retractable seat 56. The retractable seat 56 may be activated to a sealing position in response to detection of the predetermined magnetic signal by the sensor 40.

The actuator 50 may open the injection valve 16 in response to a predetermined magnetic pattern being detected by the sensor 40, and/or in response to multiple predetermined magnetic signals being detected by the sensor. At least two of the predetermined magnetic signals may be different from each other.

A method of injecting fluid 24 into selected ones of multiple zones 22*a-d* penetrated by a wellbore 14 is also described above. In one example, the method can include producing a first magnetic pattern in a tubular string 12 having multiple injection valves 16*a-e* interconnected therein, opening a first set (such as, valves 16*b,c*) of at least one of the injection valves 16*a-e* in response to the first magnetic pattern producing step, producing a second magnetic pattern in the tubular string 12, and opening a second set (such as, valve 16*a*) of at least one of the injection valves 16*a-e* in response to the second magnetic pattern producing step.

The first injection valve set 16*b,c* may open in response to the first magnetic pattern including a first predetermined number of magnetic devices 38. The second injection valve set 16*a* may open in response to the second magnetic pattern including a second predetermined number of the magnetic devices 38.

In another aspect, the above disclosure describes a method of actuating well tools in a well. In one example, the method can include producing a first magnetic pattern in the well, thereby transmitting a corresponding first magnetic signal to the well tools (such as valves 16*a-e*, etc.), and at least one of the well tools actuating in response to detection of the first magnetic signal.

The first magnetic pattern may comprise a predetermined number of the magnetic devices 38, a predetermined spacing in time of the magnetic devices 38, or a predetermined spacing in time between predetermined numbers of the magnetic devices 38, etc. Any pattern may be used in keeping with the scope of this disclosure.

A first set of the well tools may actuate in response to detection of the first magnetic signal. A second set of the well tools may actuate in response to detection of a second magnetic signal. The second magnetic signal can correspond to a second magnetic pattern produced in the well.

The well tools can comprise valves, such as injection valves 16, or other types of valves, or other types of well tools. Other types of valves can include (but are not limited to) sliding side doors, flapper valves, ball valves, gate valves, pyrotechnic valves, etc. Other types of well tools can include packers 18*a-e*, production control, conformance, fluid segregation, and other types of tools.

The method may include injecting fluid 24 outward through the injection valves 16*a-e* and into a formation 22 surrounding a wellbore 14.

The method may include detecting the first magnetic signal with a magnetic sensor 40.

The magnetic pattern can comprise a predetermined magnetic field pattern (such as, the pattern of magnetic field-producing components on the magnetic device 38 of FIGS. 7 & 8, etc.), a predetermined pattern of multiple magnetic fields (such as, a pattern produced by displacing multiple magnetic devices 38 in a certain manner through the well, etc.), a predetermined change in a magnetic field (such as, a change produced by displacing a metallic device past or to the sensor 40), and/or a predetermined pattern of multiple magnetic field changes (such as, a pattern produced by displacing multiple metallic devices in a certain manner past or to the sensor 40, etc.).

In one example, a magnetic device 38 described above can include multiple magnetic field-producing components arranged in a pattern on a sphere 76. The magnetic field-producing components may comprise permanent magnets 68.

The pattern may comprise spaced apart positions distributed along a continuous undulating path about the sphere 76.

The magnetic field-producing components may be positioned in recesses 74 formed on the sphere 76.

The actuating can be performed by piercing a pressure barrier 48.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of injecting fluid into selected ones of multiple zones penetrated by a wellbore, the method comprising:

displacing at least one first magnetic device in the wellbore;

after a predetermined spacing in time, displacing at least one second magnetic device in the wellbore;

a valve actuating in response to the predetermined spacing in time between the displacing of the first and second magnetic devices, the actuating comprising piercing a pressure barrier; and injecting the fluid through the valve and into at least one of the zones associated with the valve.

2. The method of claim 1, wherein the displacing at least one first magnetic device further comprises displacing a predetermined number of the first magnetic devices in the wellbore.

3. The method of claim 1, wherein the displacing at least one second magnetic device further comprises displacing a predetermined number of the second magnetic devices in the wellbore.

4. The method of claim 1, wherein a sensor of the valve detects a magnetic field.

5. The method of claim 1, wherein a sensor of the valve detects a change in a magnetic field.

6. A method of actuating at least one well tool in a well, the method comprising:

producing a first magnetic pattern in the well, thereby transmitting a corresponding first magnetic signal to the well tool, wherein the first magnetic pattern comprises a predetermined spacing in time between displacement of first and second magnetic devices in the well; and the well tool actuating in response to detection of the first magnetic signal.

7. The method of claim 6, wherein the actuating comprises piercing a pressure barrier.

8. The method of claim 6, wherein the first pattern comprises a predetermined spacing in time between predetermined numbers of magnetic devices.

9. The method of claim 6, wherein the at least one well tool comprises multiple well tools, and wherein a first well tool actuates in response to detection of the first magnetic signal.

10. The method of claim 9, wherein a second well tool actuates in response to detection of a second magnetic signal.

11. The method of claim 10, wherein the second magnetic signal corresponds to a second magnetic pattern produced in the well, and wherein the second magnetic pattern comprises a predetermined spacing in time between displacement of third and fourth magnetic devices in the well.

12. The method of claim 6, wherein the well tool comprises a valve.

13. The method of claim 12, wherein the valve comprises an injection valve.

14. The method of claim 13, further comprising injecting fluid outward through the injection valve and into a formation surrounding a wellbore.

15. The method of claim 6, further comprising detecting the first magnetic signal with a magnetic sensor.

16. The method of claim 15, wherein the magnetic sensor comprises an inductive sensor.

17. A method of injecting fluid into selected ones of multiple zones penetrated by a wellbore, the method comprising:

producing a first magnetic pattern in a tubular string having multiple injection valves interconnected therein, wherein the first magnetic pattern comprises a predetermined spacing in time between displacement of first and second magnetic devices in the wellbore;

actuating a first injection valve in response to the first magnetic pattern producing;

producing a second magnetic pattern in the tubular string, wherein the second magnetic pattern comprises a predetermined spacing in time between displacement of third and fourth magnetic devices in the wellbore; and actuating a second injection valve in response to the second magnetic pattern producing.

18. The method of claim 17, wherein the first magnetic pattern comprises a predetermined spacing in time between displacement of predetermined numbers of the first and second magnetic devices.

19. The method of claim 17, wherein the second magnetic pattern comprises a predetermined spacing in time between displacement of predetermined numbers of the third and fourth magnetic devices.

20. The method of claim 17, wherein the first injection valve actuates in response to at least one first sensor detecting the first magnetic pattern.

21. The method of claim 17, wherein the second injection valve actuates in response to at least one second sensor detecting the second magnetic pattern.

* * * * *